US009983605B2

(12) United States Patent
Duong et al.

(10) Patent No.: US 9,983,605 B2
(45) Date of Patent: May 29, 2018

(54) VOLTAGE REGULATOR FOR SUPPRESSING OVERSHOOT AND UNDERSHOOT AND DEVICES INCLUDING THE SAME

(71) Applicant: Samsung Electronics Co., Ltd., Suwon-si, Gyeonggi-do (KR)

(72) Inventors: Hoang Quoc Duong, Seoul (KR); Sung Woo Moon, Seongnam-si (KR); Hyun Seok Shin, Suwon-si (KR); Dong Jin Keum, Suwon-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 5 days.

(21) Appl. No.: 15/230,849

(22) Filed: Aug. 8, 2016

(65) Prior Publication Data

US 2017/0199537 A1 Jul. 13, 2017

(30) Foreign Application Priority Data

Jan. 11, 2016 (KR) ..... 10-2016-0003185

(51) Int. Cl.
*G05F 1/575* (2006.01)

(52) U.S. Cl.
CPC ..... *G05F 1/575* (2013.01)

(58) Field of Classification Search
CPC ... G05F 1/46; G05F 1/56; G05F 1/562; G05F 1/565; G05F 1/569; G05F 1/571; G05F 1/573; G05F 1/575
See application file for complete search history.

(56) References Cited

U.S. PATENT DOCUMENTS

| | | | | |
|---|---|---|---|---|
| 6,201,375 | B1 | 3/2001 | Larson et al. | |
| 6,333,623 | B1 | 12/2001 | Heisley et al. | |
| 6,388,433 | B2 | 5/2002 | Marty | |
| 7,199,565 | B1 | 4/2007 | Demolli | |
| 7,221,213 | B2 | 5/2007 | Lee et al. | |
| 7,714,553 | B2 | 5/2010 | Lou | |
| 8,129,962 | B2 | 3/2012 | Xie et al. | |
| 8,294,441 | B2 | 10/2012 | Gurcan et al. | |
| 8,344,713 | B2 | 1/2013 | Shrivas et al. | |
| 8,860,389 | B2 | 10/2014 | Gakhar et al. | |
| 2005/0275394 | A1* | 12/2005 | Moraveji ..... | G05F 1/565 323/312 |

(Continued)

*Primary Examiner* — Jeffrey Gblende
*Assistant Examiner* — David A. Singh
(74) *Attorney, Agent, or Firm* — Harness, Dickey & Pierce, P.L.C.

(57) ABSTRACT

A voltage regulator may include an error amplifier configured to amplify a difference between a reference voltage and a feedback voltage and generate a first amplified voltage based thereon; a power transistor between a second voltage supply node and an output node of the voltage regulator, the power transistor including a gate configured to receive a gate voltage; a buffer between a first voltage supply node and a ground, the buffer configured to generate the gate voltage based on the first amplified voltage; a voltage divider between the output node and the ground, the voltage divider configured to generate the feedback voltage based on the output voltage; and a control circuit configured to connect the output node to the ground through the gate of the power transistor based on the output voltage and the gate voltage.

20 Claims, 13 Drawing Sheets

(56) References Cited

U.S. PATENT DOCUMENTS

| | | | | |
|---|---|---|---|---|
| 2006/0108993 | A1* | 5/2006 | Chien | G05F 1/565 323/282 |
| 2006/0170401 | A1* | 8/2006 | Chen | G05F 1/575 323/273 |
| 2008/0012543 | A1* | 1/2008 | Negoro | G05F 1/46 323/272 |
| 2009/0167266 | A1* | 7/2009 | Al-Shyoukh | G05F 1/569 323/276 |
| 2010/0039082 | A1* | 2/2010 | Xie | G05F 1/565 323/281 |
| 2013/0083573 | A1* | 4/2013 | Ryu, II | H02M 3/07 363/60 |
| 2013/0113447 | A1* | 5/2013 | Kadanka | G05F 1/56 323/280 |
| 2016/0211751 | A1* | 7/2016 | Kurozo | G05F 1/573 |
| 2016/0291618 | A1* | 10/2016 | Wismar | G05F 1/575 |
| 2017/0090494 | A1* | 3/2017 | Cui | G05F 1/562 |

* cited by examiner

VOLTAGE REGULATOR FOR SUPPRESSING OVERSHOOT AND UNDERSHOOT AND DEVICES INCLUDING THE SAME

CROSS-REFERENCE TO RELATED APPLICATION

This application claims priority under 35 U.S.C. § 119(a) from Korean Patent Application No. 10-2016-0003185 filed on Jan. 11, 2016, the disclosure of which is hereby incorporated by reference in its entirety.

BACKGROUND

At least some example embodiments of the inventive concepts relate to a voltage regulator and/or devices including the same. For example, at least some example embodiments relate to a voltage regulator for suppressing overshoot and undershoot and/or devices including the same.

With the rapid development of the mobile devices, mobile devices may have increasingly advanced functionality; however, the capacity of batteries of the mobile devices is limited. Therefore, manufacturers are focusing on increasing the use time of mobile devices by affectively using the battery rather than attempting to increase the capacity of the battery.

A mobile device usually includes a low-dropout (LDO) regulator which is provided with an operating voltage from a power management integrated circuit (IC) included in the mobile device. The LDO regulator may convert the operating voltage into an output voltage utilized by a semiconductor chip included in the mobile device. To convert the operating voltage to the output voltage, the LDO regulator may need to sufficiently secure a dropout voltage, i.e., a difference between an input voltage and the output voltage in order to correctly generate the output voltage.

When the dropout voltage is too small, the overall feedback loop gain of the LDO regulator may decrease, thus causing a large error in the output voltage of the LDO regulator. Although it is advantageous in design to sufficiently secure the dropout voltage, power efficiency of the LDO regulator may decrease as the dropout voltage increases. When there is a rapid change in an output current of the LDO regulator, i.e., a current used at a load connected to the LDO regulator; overshoot and undershoot may occur in the output voltage of the LDO regulator.

SUMMARY

Some example embodiments of the inventive concepts provide a voltage regulator for suppressing overshoot and undershoot using a diode formed by a transistor connected between the gate and source of a power transistor and an internal fast loop coupled to the connection transistor and devices including the same.

According to some example embodiments of the inventive concepts, there is provided a voltage regulator configured to receive a first voltage at a first voltage supply node, and to supply an output voltage to an output node.

In some example embodiments, the voltage regulator includes an error amplifier configured to amplify a difference between a reference voltage and a feedback voltage and generate a first amplified voltage based thereon; a power transistor between a second voltage supply node and the output node of the voltage regulator, the power transistor including a gate configured to receive a gate voltage; a buffer between the first voltage supply node and a ground, the buffer configured to generate the gate voltage based on the first amplified voltage; a voltage divider between the output node and the ground, the voltage divider configured to generate the feedback voltage based on the output voltage; and a control circuit configured to connect the output node to the ground through the gate of the power transistor based on the output voltage and the gate voltage.

According to other example embodiments of the inventive concepts, there is provided an integrated circuit including a load connected to the output node; and the voltage regulator configured to supply the output voltage to the output node.

According to other example embodiments of the inventive concepts, there is provided a mobile device.

In some example embodiments, the mobile device includes a power management integrated circuit configured to generate an operating voltage; and a voltage regulator configured to receive the operating voltage and to supply an output voltage to an output node, the voltage regulator including, an error amplifier configured to amplify a difference between a reference voltage and a feedback voltage and generate a first amplified voltage based thereon, a power transistor between a voltage supply node and the output node, the voltage supply node configured to receive the operating voltage, the power transistor including a gate configured to receive a gate voltage, a buffer between the voltage supply node and a ground, the buffer configured to generate the gate voltage based on the first amplified voltage, a voltage divider between the output node and the ground, the voltage divider configured to generate the feedback voltage based on the output voltage, and a control circuit configured to discharge current flowing into the output node to the ground through the gate of the power transistor based on the output voltage and the gate voltage.

According to other example embodiments of the inventive concepts, there is provided a voltage regulator configured to supply an output voltage to an output node.

In some example embodiments, the voltage regulator includes a power transistor between a voltage supply node and the output node, the voltage supply node configured to receive an operating voltage, the power transistor including a gate configured to receive a gate voltage; and a control circuit configured to, suppress overshoot in the output voltage by connecting the gate of the power transistor with a ground to discharge current from the output node, and suppress undershoot in the output voltage by connecting the gate of the power transistor to the output node to increase the gate voltage to the operating voltage.

BRIEF DESCRIPTION OF THE DRAWINGS

The above and other features and advantages of the example embodiments of the inventive concepts will become more apparent by describing in detail some example embodiments thereof with reference to the attached drawings in which.

DETAILED DESCRIPTION

Figure 1:
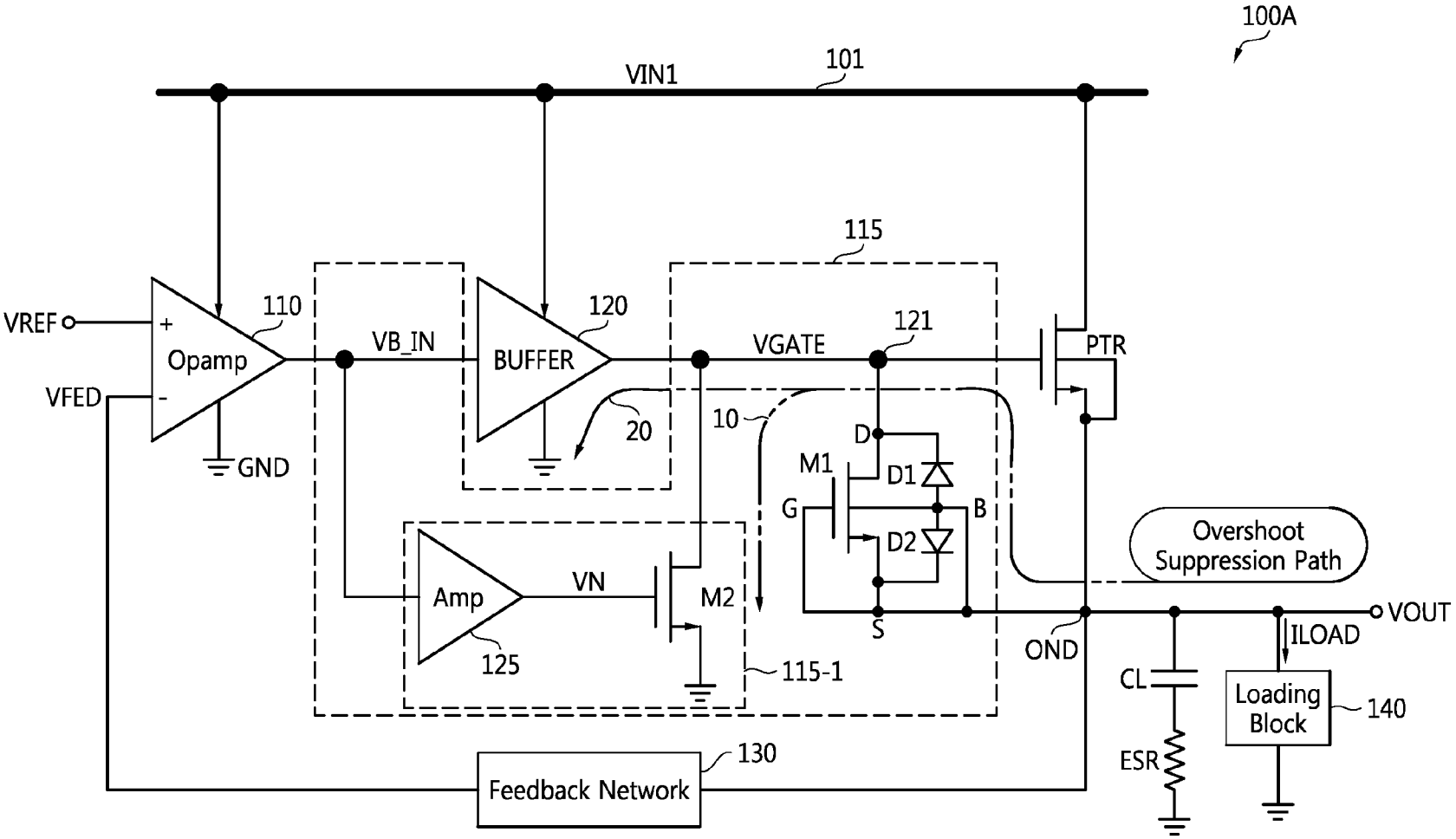
FIG. 1 is a circuit diagram of a voltage regulator, which uses single power and suppresses overshoot, according to some example embodiments of the inventive concepts.

Example embodiments of the inventive concepts now will be described more fully hereinafter with reference to the accompanying drawings, in which embodiments of the invention are shown. Example embodiments may, however, be embodied in many different forms and should not be construed as limited to the example embodiments set forth herein. Rather, these example embodiments are provided so that this disclosure will be thorough and complete, and will fully convey the scope of the example embodiments to those skilled in the art. In the drawings, the size and relative sizes of layers and regions may be exaggerated for clarity. Like numbers refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein, the term "and/or" includes any and all combinations of one or more of the associated listed items and may be abbreviated as "/".

It will be understood that, although the terms first, second, etc. may be used herein to describe various elements, these elements should not be limited by these terms. These terms are only used to distinguish one element from another. For example, a first signal could be termed a second signal, and, similarly, a second signal could be termed a first signal without departing from the teachings of the disclosure.

The terminology used herein is for the purpose of describing particular example embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and/or the present application, and will not be interpreted in an idealized or overly formal sense unless expressly so defined herein.

FIG. 1 is a circuit diagram of a voltage regulator 100A, which uses single power and suppresses overshoot, according to some example embodiments of the inventive concepts.

Referring to FIG. 1, the voltage regulator 100A may include a first loop, a second loop, and a connection transistor M1.

For clarity of the description, a capacitor CL and a resistor ESR, which are connected in series between an output node OND of the voltage regulator 100A and a ground GND, and a loading block 140 connected between the output node OND and the ground GND are illustrated in FIG. 1 together with the voltage regulator 100A.

In some example embodiments, the voltage regulator 100A and the loading block 140 may be integrated into or embedded in an integrated circuit (IC), a system-on-chip (SoC), a processor, an application processor, a memory controller, or a display driver IC.

The loading block 140 may be a circuit (e.g., a digital logic circuit or an analog circuit) which uses an output voltage VOUT of the voltage regulator 100A but is not restricted thereto. A load current ILOAD output from the voltage regulator 100A may be supplied to the loading block 140. The voltage regulator 100A may be a low-dropout (LDO) voltage regulator.

The first loop may be a main loop. The first loop may include an error amplifier 110, a buffer 120, a power transistor PTR, and a feedback network 130. The first loop may control the output voltage VOUT proportional to a reference voltage VREF.

The error amplifier 110 may use a first voltage VIN1 supplied through a first voltage supply node 101 and a ground voltage supplied through the ground GND as operating voltages, may amplify a difference between the reference voltage VREF and a feedback voltage VFED, and may output an amplified voltage VB_IN. The error amplifier 110 may be implemented as an operational amplifier.

For example, the reference voltage VREF may be input to a positive (+) terminal of the error amplifier 110 and the feedback voltage VFED may be input to a negative (−) terminal of the error amplifier 110. In this case, the output voltage VB_IN of the error amplifier 110 may decrease when the feedback voltage VFED increases and may increase when the feedback voltage VFED decreases.

The buffer 120 may use the first voltage VIN1 and the ground voltage as operating voltages and may control a gate 121 of the power transistor PTR using the output voltage VB_IN of the error amplifier 110. For example, the buffer 120 may supply a voltage proportional to the output voltage VB_IN of the error amplifier 110 to the gate 121 of the power transistor PTR.

The power transistor PTR may be connected between the first voltage supply node 101 and the output node OND of the voltage regulator 100A and may control the output voltage VOUT of the output node OND based on a gate voltage VGATE, i.e., an output voltage of the buffer 120. The power transistor PTR may be implemented as an N-channel metal-oxide semiconductor (NMOS) transistor. The body of the power transistor PTR may be connected to a source of the power transistor PTR.

Figure 7:
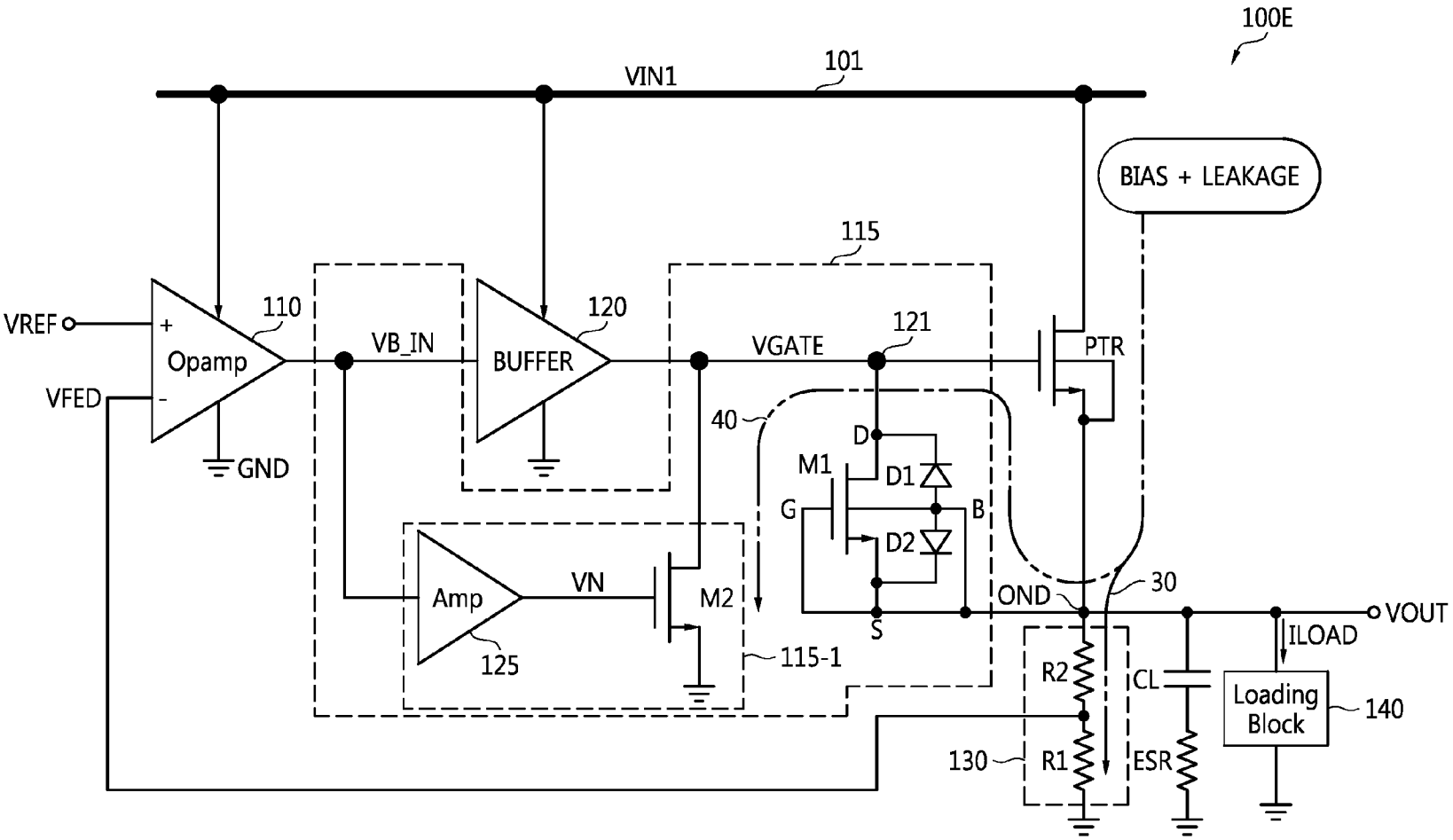
FIG. 7 is a conceptual diagram for explaining an operation of discharging leakage current from the voltage regulator illustrated in FIG. 1.

The feedback network 130 may be connected between the output node OND and the ground GND and may generate the feedback voltage VFED based on the output voltage VOUT of the output node OND. For example, the feedback network 130 may be implemented as a voltage divider including resistors R1 and R2, as shown in FIG. 7. In other words, a voltage output from the voltage divider 130 may be supplied to the error amplifier 110 as the feedback voltage WED. The feedback voltage VFED may be dependent on the output voltage VOUT.

The second loop may include a first internal fast loop 115-1. The first internal fast loop 115-1 may include a first amplifier 125 and a discharging transistor M2. The first internal fast loop 115-1 may be a first switch circuit. The discharging transistor M2 is an embodiment of a pull-down circuit. The pull-down circuit may control connection between the gate 121 of the power transistor PTR and the ground GND in response to an output signal VN of the first amplifier 125.

The first internal fast loop 115-1 may quickly discharge the voltage VGATE of the gate 121 of the power transistor PTR to the ground GND for fast response to a step output load current (e.g., the current ILOAD).

The first amplifier 125 may control a gate of the discharging transistor M2 using the output voltage VB_IN of the error amplifier 110. For example, the output voltage VN of the first amplifier 125 may increase when the output voltage VB_IN of the error amplifier 110 decreases and may decrease when the output voltage VB_IN of the error amplifier 110 increases.

The connection transistor M1 is connected between the gate 121 of the power transistor PTR and a source of the power transistor PTR, i.e., the output node OND. The connection transistor M1 illustrated in FIGS. 1 through 5 and FIGS. 7 and 8 is an embodiment of a connection circuit which controls the connection between the gate 121 of the power transistor PTR and the source of the power transistor PTR based on the difference between the voltage VGATE of the gate 121 and the output voltage VOUT. However, example embodiments are not limited thereto, and, as such, the connection circuit is not restricted to the connection transistor M1.

When there is overshoot in the output node OND, the connection transistor M1 may be turned on to discharge current from the output node OND through the buffer 120 and/or the discharging transistor M2.

Figures 6A, 6B, 6C, 6D:
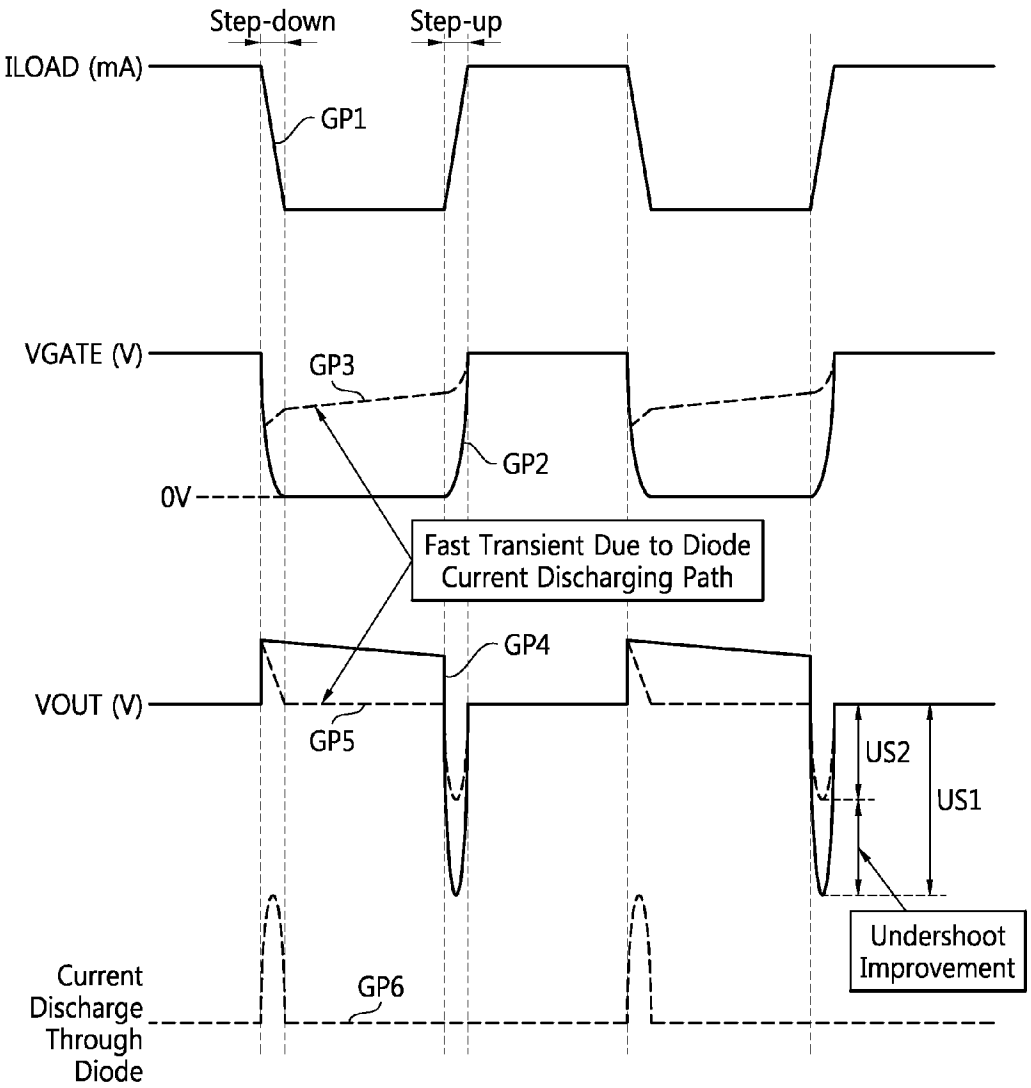
FIGS. 6A through 6D are timing charts showing the principle of an operation of suppressing overshoot and undershoot in the voltage regulators illustrated in FIGS. 1 through 4.

In addition, the connection transistor M1 may keep the voltage VGATE of the gate 121 of the power transistor PTR higher than 0 (zero) V so that the voltage VGATE does not drop to 0V. Accordingly, when the load current ILOAD is stepped up, the response speed of the voltage VGATE of the gate 121 can be increased. As shown in FIG. 6C, undershoot characteristics are better in the voltage regulator 100A than in conventional LDO voltage regulators.

The connection transistor M1 connected between the gate 121 and source of the power transistor PTR remains in an off-state in normal operation conditions. However, when overshoot occurs in the output node OND (or the output voltage VOUT is overshot), that is, when the voltage VGATE of the gate 121 of the power transistor PTR is lower than the output voltage VOUT, a first diode D1 formed between a body B and drain D of the connection transistor M1 is turned on or conducted. As a result, the current of the output node OND is discharged to the ground GND through the buffer 120 and/or the discharging transistor M2 until the first diode D1 is turned off.

In other words, a first (discharge) current path 10 and a second (discharge) current path 20 are formed and maintained until the connection transistor M1 for suppressing overshoot is turned off. The first current path 10 may include the first diode D1 of the connection transistor M1 and the discharging transistor M2. The second current path 20 may include the first diode D1 of the connection transistor M1 and the buffer 120.

The connection transistor M1 may also discharge leakage current flowing across the power transistor PTR to the ground GND through the first current path 10 and/or the second current path 20. For example, when quiescent current of the power transistor PTR, i.e., bias current defined by the resistors R1 and R2 is lower than the leakage current as the leakage current is supplied to the output node OND through the power transistor PTR; the capacitor CL connected to the output node OND is charged with the leakage current and the output voltage VOUT of the output node OND is increased.

Accordingly, when a conduction condition of the first diode D1 is satisfied, the leakage current flowing through the power transistor PTR are discharged to the ground GND through the first current path 10 and/or the second current path 20 until the first diode D1 is turned off.

A body-to-drain diode, i.e., the first diode D1 formed by the connection transistor M1 may also discharge a reverse current to the ground GND through the first current path 10 and/or the second current path 20. The load current ILOAD supplied to the loading block 140 through the power transistor PTR may be referred to as forward current and a current flowing from the loading block 140 toward the power transistor PTR may be referred to as a reverse or backward current.

As described above, the output voltage VOUT of the output node OND may increase or rapidly increase due to overshoot, leakage current, and/or reverse current.

The first internal fast loop, i.e., the first switch circuit 115-1 may quickly discharge the voltage VGATE of the gate 121 of the power transistor PTR to the ground GND in order to quickly respond to the step output load current (e.g., the load current ILOAD). The first switch circuit 115-1 may detect the output voltage VB_IN of the error amplifier 110 and may control the connection between the gate 121 of the power transistor PTR and the ground GND according to the detection result.

For example, the step output load current may be the load current ILOAD having a waveform shown in a first graph GP1 illustrated in FIG. 6A. When the load current ILOAD rapidly transits from a high level to a low level, a large overshoot may occur in the output voltage VOUT, as shown in FIG. 6C. When the load current ILOAD rapidly transits from the low level to the high level; a large undershoot may occur in the output voltage VOUT, as shown in FIG. 6C.

The first current path 10 and/or the second current path 20 may be current discharging path(s) for suppressing the overshoot of the output voltage VOUT, the output voltage VOUT increased by the leakage current of the power transistor PTR, and/or the output voltage VOUT increased by the reverse current.

The voltage regulator 100A may include the error amplifier 110, a control circuit 115, the buffer 120, the power transistor PTR, and the feedback network 130.

The control circuit 115 may control the voltage VGATE of the gate 121 and the output voltage VOUT based on the output voltage VB_IN of the error amplifier 110, the voltage VGATE of the gate 121 of the power transistor PTR, and the output voltage VOUT of the output node OND.

For example, when overshoot occurs in the output voltage VOUT, the output voltage VOUT increases and the feedback voltage VFED dependent on the output voltage VOUT also increases. When the turn-on or conduction condition of the first diode D1 is satisfied as the output voltage VOUT increases, a current path is formed between the output node OND and the gate 121 of the power transistor PTR. In addition, when the feedback voltage VFED increases, the output voltage VB_IN of the error amplifier 110 decreases, and therefore, the output voltage VN of the first amplifier 125 increases. As a result, the discharging transistor M2 is turned on, thereby forming the first current path 10. At this time, the buffer 120 is operating, so that the second current path 20 is also formed.

Figure 2:
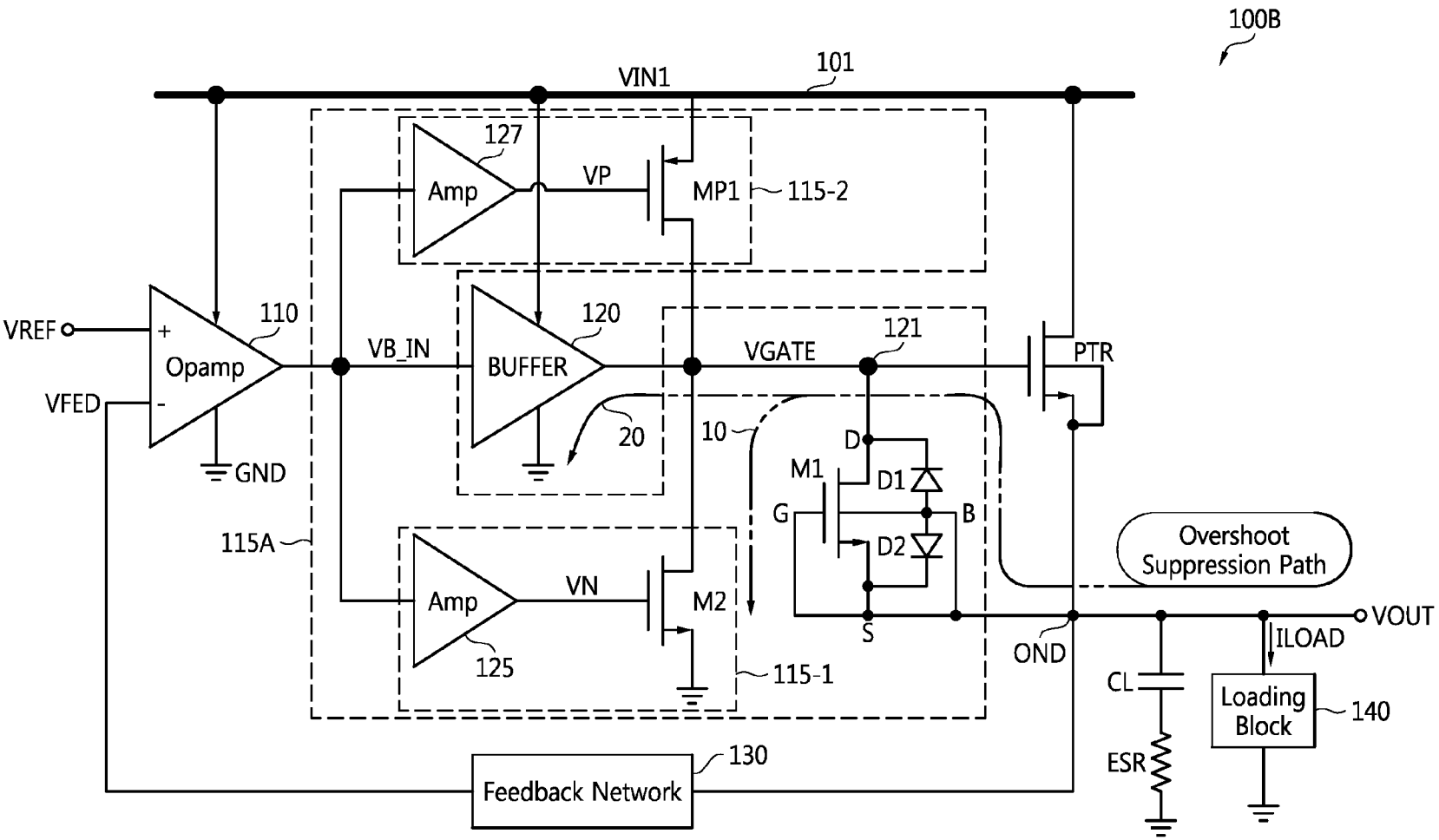
FIG. 2 is a circuit diagram of a voltage regulator, which uses single power and suppresses overshoot and undershoot, according to some example embodiments of the inventive concepts.

FIG. 2 is a circuit diagram of a voltage regulator 100B, which uses single power and suppresses overshoot and undershoot, according to other example embodiments of the inventive concepts.

Referring to FIGS. 1 and 2, the second loop of the voltage regulator 100B may also include a second internal fast loop 115-2 as well as the first internal fast loop 115-1. The second internal fast loop 115-2 may include a second amplifier 127 and a charging transistor MP1. The second internal fast loop 115-2 may be a second switch circuit. The charging transistor MP1 is an embodiment of a pull-up circuit. The pull-up circuit may control the connection between the first voltage supply node 101 and the gate 121 of the power transistor PTR in response to an output signal VP of the second amplifier 127.

The second internal fast loop 115-2 may quickly charge the voltage VGATE of the gate 121 of the power transistor PTR to the first voltage VIN1 for fast response to a step output load current (e.g., the current ILOAD).

A control circuit 115A illustrated in FIG. 2 may include the first switch circuit 115-1, the second switch circuit 115-2, and the connection transistor M1. The control circuit 115A may control the voltage VGATE of the gate 121 and the output voltage VOUT based on the output voltage VB_IN of the error amplifier 110, the voltage VGATE of the gate 121 of the power transistor PTR, and the output voltage VOUT of the output node OND.

As described above with reference to FIG. 1, when overshoot occurs in the output voltage VOUT (or in an overshoot state), the overshoot of the output voltage VOUT is suppressed through the first current path 10 and/or the second current path 20. In other words, the output voltage VOUT may be discharged to the ground GND through the first current path 10 and/or the second current path 20.

When undershoot occurs in the output voltage VOUT (or in an undershoot state), the output voltage VOUT decreases and the feedback voltage VFED dependent on the output voltage VOUT also decreases. As the output voltage VOUT decreases, the turn-on or conduction condition of the first diode D1 is not satisfied. When the feedback voltage VFED decreases, the output voltage VB_IN of the error amplifier 110 increases. Accordingly, the output voltage VN of the first amplifier 125 and the output voltage VP of the second amplifier 127 decrease, and therefore, the discharge transistor M2 is turned off and the charging transistor MP1 is turned on. As a result, the charging transistor MP1 supplies the first voltage VIN1 to the gate 121 of the power transistor PTR, the voltage VGATE of the gate 121 of the power transistor PTR increase up to the first voltage VIN1.

Figure 3:
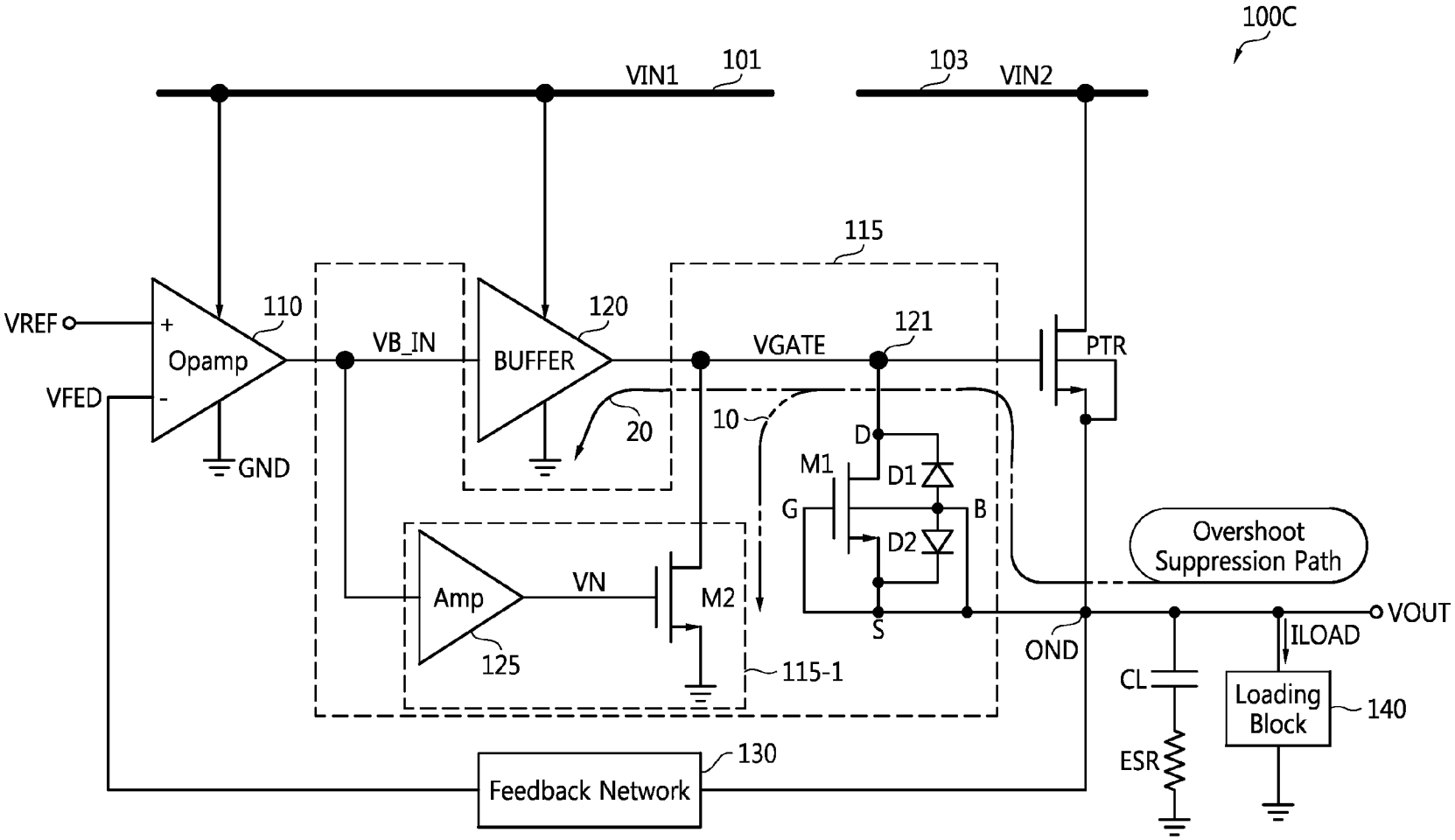
FIG. 3 is a circuit diagram of a voltage regulator, which uses multi-power and suppresses overshoot, according to some example embodiments of the inventive concepts.

FIG. 3 is a circuit diagram of a voltage regulator 100C, which uses multi-power and suppresses overshoot, according to some example embodiments of the inventive concepts.

Referring to FIGS. 1 and 3, while the voltage regulator 100A using single power VIN1 is illustrated in FIG. 1, the voltage regulator 1000 using multi-power VIN1 and VIN2 is illustrated in FIG. 3.

While the first voltage VIN1 is supplied to the error amplifier 110, the buffer 120, and the power transistor PTR in the example embodiments illustrated in FIG. 1; the first voltage VIN1 is supplied to the error amplifier 110 and the buffer 120 and a second voltage VIN2 is supplied to the power transistor PTR in the example embodiments illustrated in FIG. 3.

In other words, the power transistor PTR is connected between a second voltage supply node 103 supplying the second voltage VIN2 and the output node OND of the voltage regulator 100C in the example embodiments illustrated in FIG. 3. Apart from using the multi-power VIN1 and VIN2, the structure and operations of the voltage regulator 100C illustrated in FIG. 3 are the same as those of the voltage regulator 100C illustrated in FIG. 1. Thus, detailed descriptions of the voltage regulator 100C will be omitted. The first voltage VIN1 may be higher than the second voltage VIN2.

Figure 4:
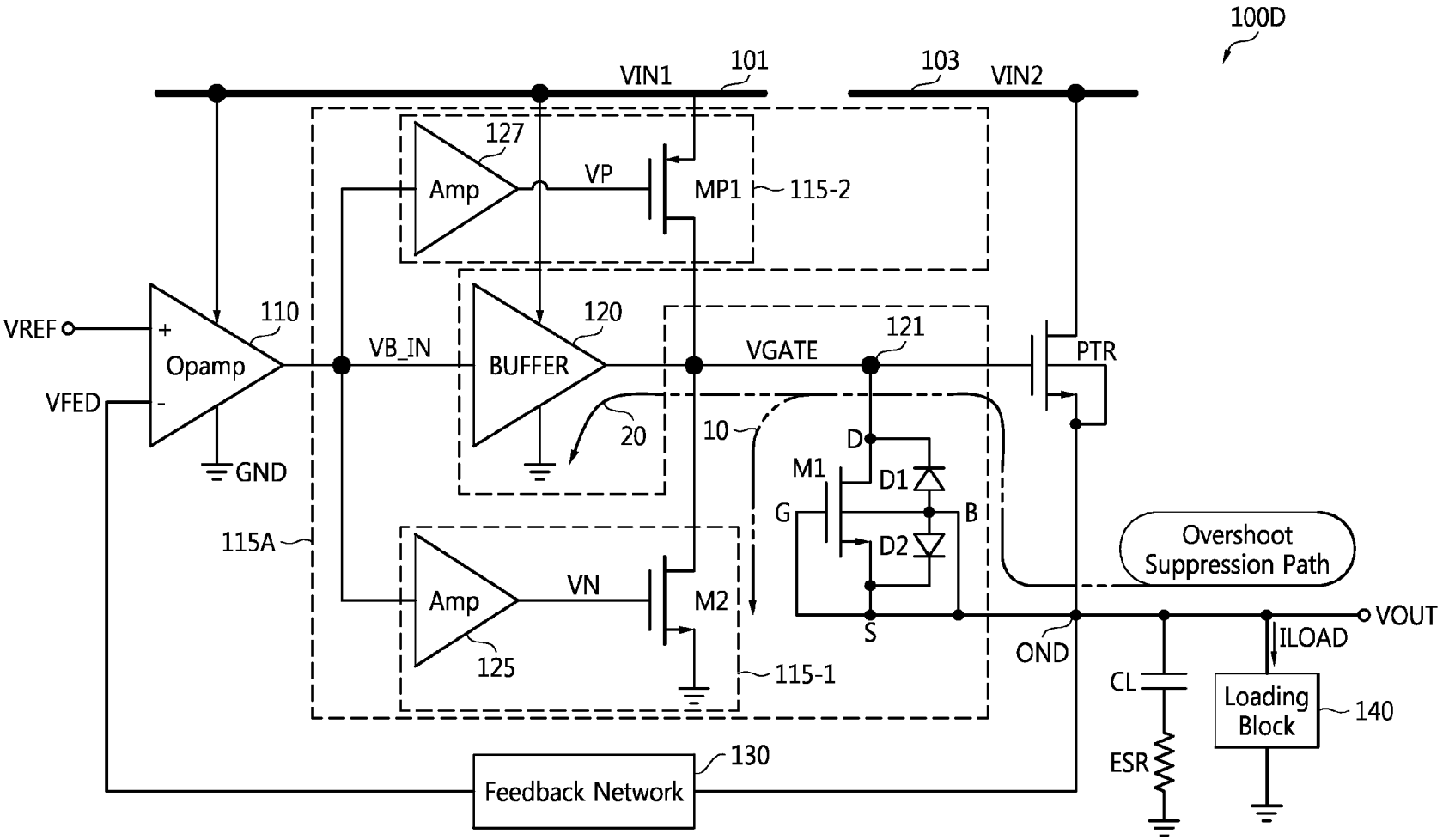
FIG. 4 is a circuit diagram of a voltage regulator, which uses multi-power and suppresses overshoot and undershoot, according to some example embodiments of the inventive concepts.

FIG. 4 is a circuit diagram of a voltage regulator 100D, which uses multi-power and suppresses overshoot and undershoot, according to some example embodiments of the inventive concepts.

Referring to FIGS. 2 and 4, while the voltage regulator 100B using single power VIN1 is illustrated in FIG. 2, the voltage regulator 100D using the multi-power VIN1 and VIN2 is illustrated in FIG. 4.

While the first voltage VIN1 is supplied to the error amplifier 110, the buffer 120, and the power transistor PTR in the embodiments illustrated in FIG. 2; the first voltage VIN1 is supplied to the error amplifier 110 and the buffer 120 and the second voltage VIN2 is supplied to the power transistor PTR in the embodiments illustrated in FIG. 4.

In other words, the power transistor PTR is connected between the second voltage supply node 103 supplying the second voltage VIN2 and the output node OND of the voltage regulator 100D in the embodiments illustrated in FIG. 4. Apart from using the multi-power VIN1 and VIN2, the structure and operations of the voltage regulator 100D illustrated in FIG. 4 are the same as those of the voltage regulator 100B illustrated in FIG. 2. Thus, detailed descriptions of the voltage regulator 100D will be omitted.

The amplifiers 125 and 127 illustrated in FIGS. 1 through 4 may operate using the first voltage VIN1 as an operating voltage.

Figure 5B:
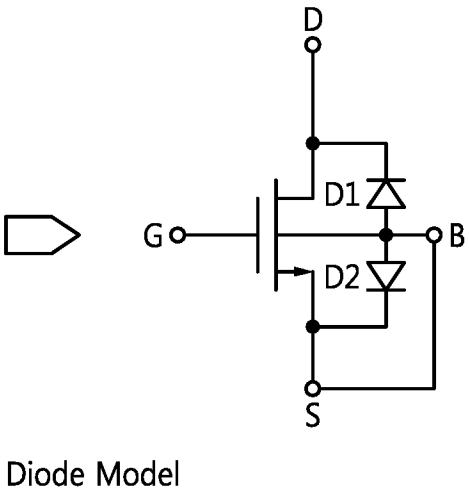
FIG. 5A is a diagram of the structure of a connection transistor illustrated in FIGS. 1 through 4 and FIG. 5B is a diagram of a diode model for the connection transistor.
Figure 5A:
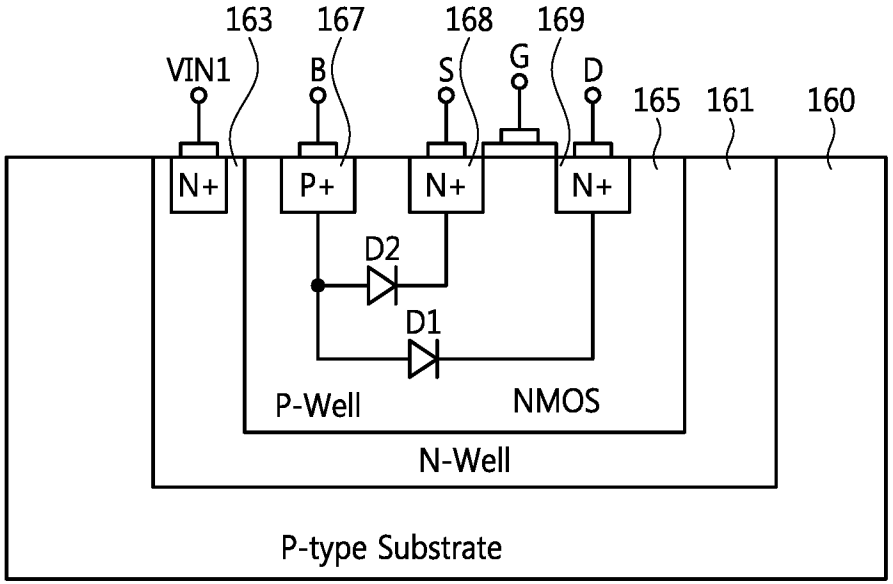

FIG. 5A is a diagram of the structure of the connection transistor M1 illustrated in FIGS. 1 through 4 and FIG. 5B is a diagram of a diode model for the connection transistor M1.

Referring to FIG. 5A, an n-well 161 is formed in a p-type substrate 160. An electrode receiving the first voltage VIN1 is connected to an n+ region 163 formed in the n-well 161. A p-well 165 is formed in the n-well 161. Diodes D1 and D2 are formed in the p-well 165. An electrode of the body B is connected to a p+ region 167 formed in the p-well 165. An electrode of a source S is connected to an n+ region 168 formed in the p-well 165. An electrode of the drain D is connected to an n+ region 169 formed in the p-well 165.

An anode of the first diode D1 is connected to the p+ region 167 and a cathode of the first diode D1 is connected to the n+ region 169. An anode of the second diode D2 is connected to the p+ region 167 and a cathode of the second diode D2 is connected to the n+ region 168. The body (B) and the source (S) of the connection transistor M1 are electrically connected each other.

FIGS. 6A through 6D are timing charts showing the principle of an operation of suppressing overshoot and undershoot in the voltage regulators 100A through 100D illustrated in FIGS. 1 through 4.

Referring to FIGS. 6A to 6D, the voltage regulators 100A through 100D may improve overshoot and undershoot occurring due to the load current, i.e., step output load current ILOAD illustrated in FIG. 6A.

When the load current ILOAD shown in FIG. 6A steps down from the high level to the low level, the voltage VGATE of the gate 121 of the power transistor PTR decreases due to overshoot in the output voltage VOUT in a conventional voltage regulator, e.g., a voltage regulator which does not include the control circuit 115 or 115A, as shown in a second graph GP2 illustrated in FIG. 6B. Then, the overshoot gradually decreases through the feedback network 130, as shown in a fourth graph GP4 illustrated in FIG. 6C. At this time, the voltage VGATE of the gate 121 of the power transistor PTR in the conventional voltage regulator drops nearly to 0V due to large gain of the error amplifier 110.

When the load current ILOAD illustrated in FIG. 6A steps up from the low level to the high level, it may take a relatively long time for the voltage VGATE of the gate 121 of the power transistor PTR to increase from nearly 0V to a desired voltage. As a result, a relatively large undershoot may occur as shown in the fourth graph GP4 illustrated in FIG. 6C.

However, when the voltage VGATE of the gate 121 of the power transistor PTR decreases due to overshoot in the output voltage VOUT in the voltage regulators 100A through 100D including the control circuit 115 or 115A, the body-to-drain diode, i.e., the first diode D1 of the connection transistor M1 is conducted or turned on.

The discharging transistor M2 is turned on in response to the output voltage VN of the first amplifier 125. Accordingly, the first current path 10 and the second current path 20 are formed, so that the current of the output node OND is discharged to the ground GND through the first diode D1, the first current path 10, and the second current path 20. The output current of the voltage regulators 100A through 100D decreases according to the operation of the control circuit 115 or 115A, and therefore, the overshoot in the output voltage VOUT is suppressed as shown in a fifth graph GP5 in FIG. 6C and the voltage VGATE of the gate 121 of the power transistor PTR is maintained at a level higher than 0V (i.e., a level not so close to 0V) as shown in a third graph GP3 of FIG. 6B.

When the load current ILOAD illustrated in FIG. 6A steps up again from the low level to the high level, the voltage VGATE of the gate 121 of the power transistor PTR keeps higher than 0V as shown in the third graph GP3, and therefore, the voltage regulators 100A through 100D can quickly respond to the step-up of the load current ILOAD. As a result, as shown in the fifth graph GP5 of FIG. 6C, an undershoot US2 in the voltage regulators 100A through 100D is significantly less than an undershoot US1 in the conventional voltage regulator.

In other words, the control circuit 115 or 115A suppresses the change in the voltage VGATE of the gate 121 of the power transistor PTR, thereby suppressing overshoot and undershoot in the output voltage VOUT.

FIG. 6D shows current discharged to the ground GND through the first current path 10 and the second current path 20 using the first diode D1 when there is overshoot in the output voltage VOUT.

FIG. 7 is a conceptual diagram for explaining an operation of discharging leakage current from the voltage regulator 100A illustrated in FIG. 1.

Referring to FIG. 7, the structure and operations of a voltage regulator 100E illustrated in FIG. 7 are the same as those of the voltage regulator 100A illustrated in FIG. 1. The voltage regulator 100E may maintain the output voltage VOUT using a minimum bias current and a large leakage current of the power transistor PTR.

When a large leakage current LEAKAGE flows in the power transistor PTR, the leakage current LEAKAGE may be supplied to the capacitor CL connected to the output node OND. When the quiescent current, e.g., bias current BIAS, of the power transistor PTR is lower than the leakage current LEAKAGE flowing in the power transistor PTR; the output voltage VOUT may increase due to the leakage current LEAKAGE supplied to the capacitor CL. As a result, an error may occur in the output voltage VOUT.

In particular, when the leakage current LEAKAGE supplied to the capacitor CL connected to the output node OND of the voltage regulator 100A or 100B is very large, the output voltage VOUT may rapidly increase up to the first voltage VIN1. When the leakage current LEAKAGE supplied to the capacitor CL connected to the output node OND of the voltage regulator 100C or 100D is very large, the output voltage VOUT may rapidly increase up to the second voltage VIN2.

When the output voltage VOUT increases due to the leakage current LEAKAGE flowing in the power transistor PTR; the first diode D1 is conducted, the feedback voltage WED increases, the output voltage VB_IN of the error amplifier 110 decreases, and the output voltage VGATE of the buffer 120 decreases. When the output voltage VB_IN of the error amplifier 110 decreases, the output voltage VN of the first amplifier 125 increases and the discharging transistor M2 is turned on in response to the output voltage VN of the first amplifier 125.

The bias current BIAS defined by the resistors R1 and R2 is discharged to the ground GND through a third (discharge) current path 30 and the leakage current LEAKAGE flowing in the power transistor PTR is discharged through a fourth (discharge) current path 40, so that the level of the output voltage VOUT is maintained constant. The voltage VGATE of the gate 121 of the power transistor PTR does not decrease down to 0V or a ground voltage, as shown in the third graph GP3 of FIG. 6B.

Figure 8:
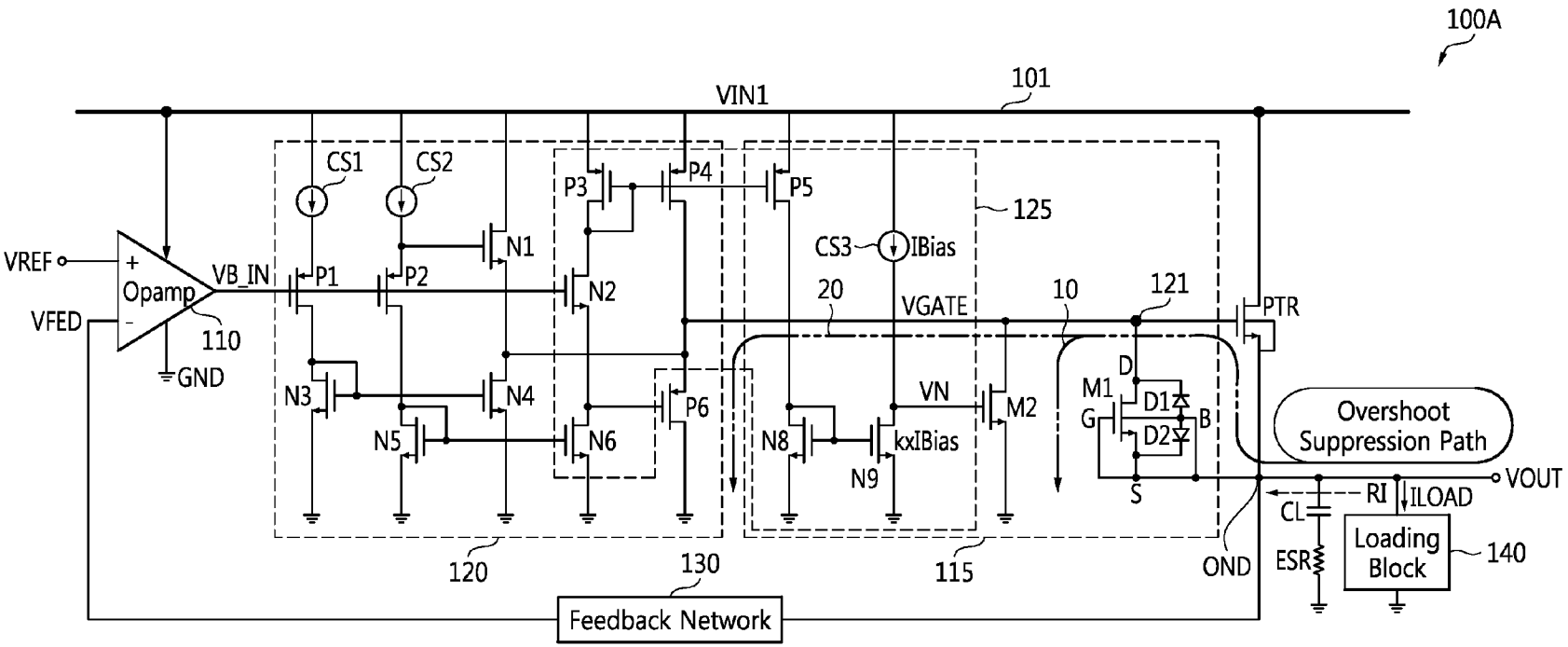
FIG. 8 is a detailed circuit diagram of the voltage regulator illustrated in FIG. 1.

FIG. 8 is a detailed circuit diagram of the voltage regulator 100A illustrated in FIG. 1.

Referring to FIGS. 1 and 8, the voltage regulator 100A may include the error amplifier 110, the control circuit 115, the buffer 10, the power transistor PTR, and the feedback network 130. The control circuit 115 may include the first amplifier 125, the connection transistor M1, and the discharging transistor M2.

The buffer 120 may include constant current sources CS1 and CS2, P-channel metal-oxide semiconductor (PMOS) transistors P1 through P4 and P6, and NMOS transistors N1 through N6. The buffer 120 may buffer the output voltage VB_IN of the error amplifier 110 and output a buffered voltage, i.e., the voltage VGATE.

The NMOS transistors N3 and N4 form a current mirror. The NMOS transistors N5 and N6 form a current mirror. The PMOS transistors P3 to P5 form a current mirror.

The first amplifier 125 may generate the voltage VN inversely proportional to the output voltage VB_IN of the error amplifier 110. The first amplifier 125 may include a constant current source CS3 supplying a constant current IBias, NMOS transistors N2, N6, N8, and N9, and PMOS transistors P3, P4 and P5. The buffer 120 and the first amplifier 125 may share MOS transistors N2, N6, P3, and P4.

The NMOS transistors N8 and N9 form a current mirror. A current flowing in the NMOS transistor N9 is "k" times of the constant current IBias. Here, "k" may be determined according to a ratio $(W/L)_8$ of a channel width W8 and channel length L8 of the NMOS transistor N8 and a ratio $(W/L)_9$ of a channel width W9 and channel length L9 of the NMOS transistor N9, that is, $k \approx ((W/L)_9/(W/L)_8)$.

The output voltage VOUT may increase due to a reverse current RI flowing from the loading block 140 toward the output node OND or the power transistor PTR. When the conduction condition of the first diode D1 is satisfied with the increase of the output voltage VOUT and the discharging transistor M2 is turned on, the first current path 10 and the second current path 20 may be formed. Accordingly, until the first diode D1 is turned off, the reverse current RI may be discharged to the ground GND through the first and second current paths 10 and 20.

Figures 9A, 9B, 9C:
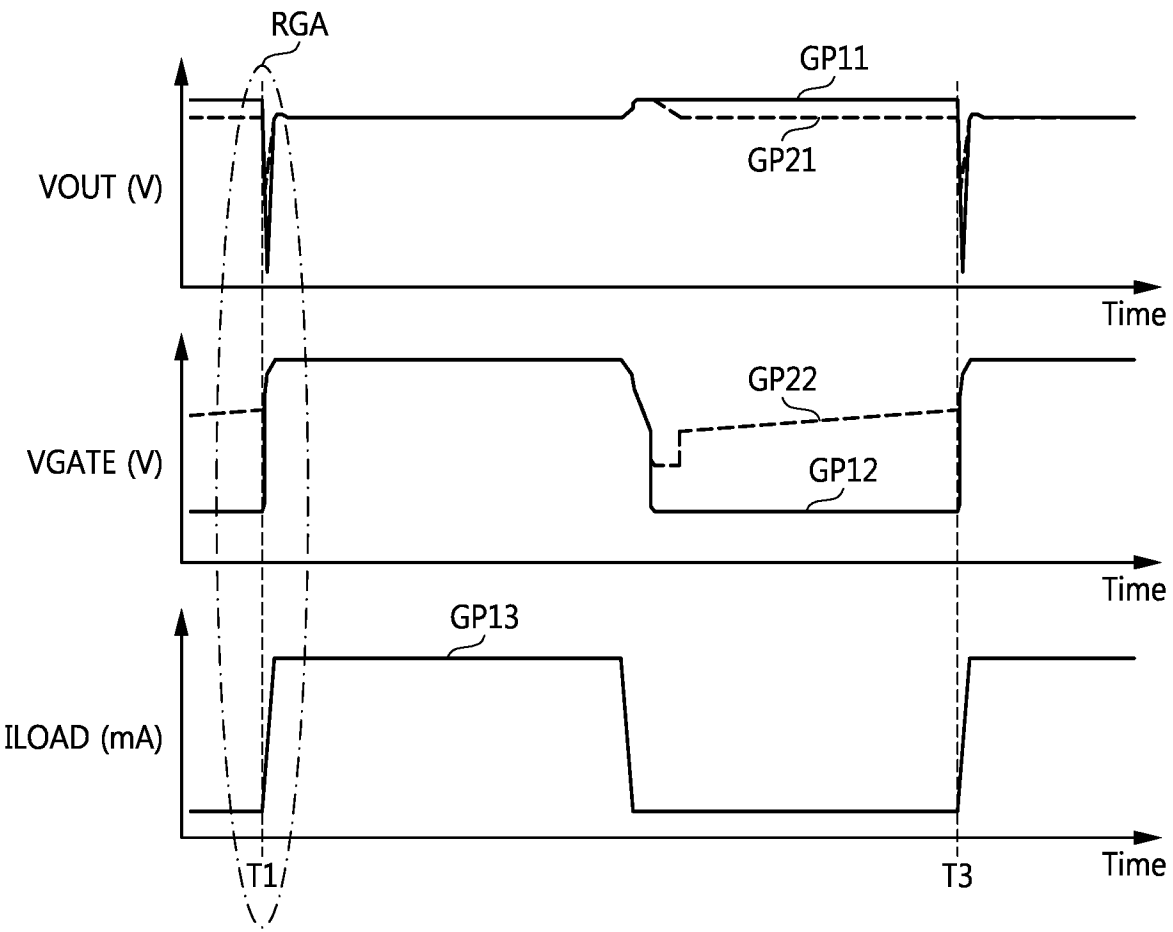
FIGS. 9A through 9C are diagrams of the results of simulating the operation of the voltage regulators illustrated in FIGS. 1 through 4 and FIGS. 7 and 8.

FIGS. 9A through 9C are diagrams of the results of simulating the operation of the voltage regulators 100A through 100E illustrated in FIGS. 1 through 4 and FIGS. 7 and 8.

Figures 10A, 10B, 10C:
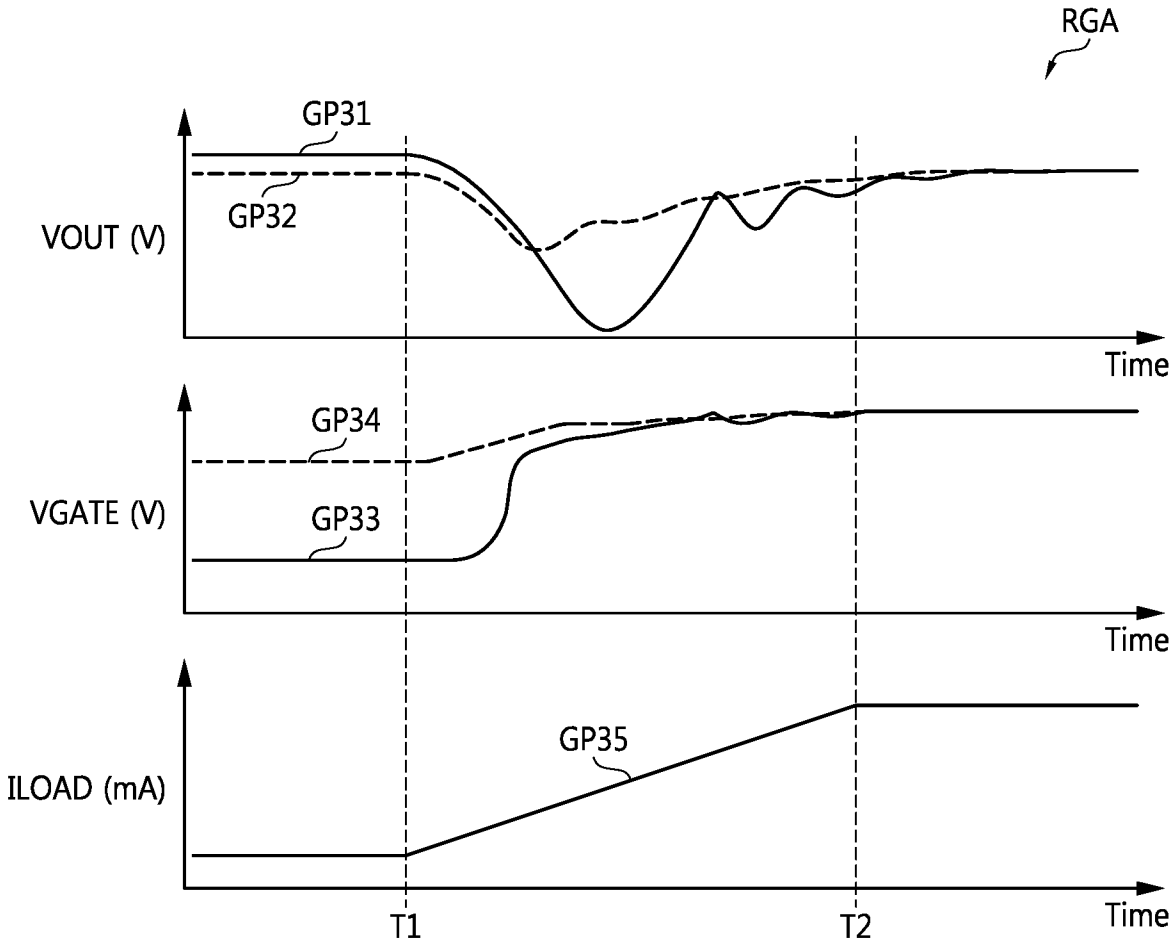
FIGS. 10A through 10C are enlarged diagrams of the portions of FIGS. 9A through 9C.

FIGS. 10A through 10C are enlarged diagrams of the portion RGA in FIGS. 9A through 9C.

Referring to FIGS. 6, 9A to 9C and 10A to 10C, in FIGS. 9A to 9C and 10A to 10C, it is assumed that T1 is 1.6 ms, T3 is 1.9 ms, and T2 is 1.605 ms.

Graphs GP11, PG12, GP13, GP31, GP33, and GP35 show the waveforms of the signals VOUT, VGATE, and ILOAD of a conventional voltage regulator which does not include the control circuit 115 or 115A. Graphs GP21, GP22, GP32, and GP34 show the waveforms of the signals VOUT and VGATE of the voltage regulators 100A through 100D including the control circuit 115 or 115A according to example embodiments of the inventive concepts.

The voltage regulators 100A through 100D suppress overshoot and undershoot unlike the conventional voltage regulator.

Figure 11:
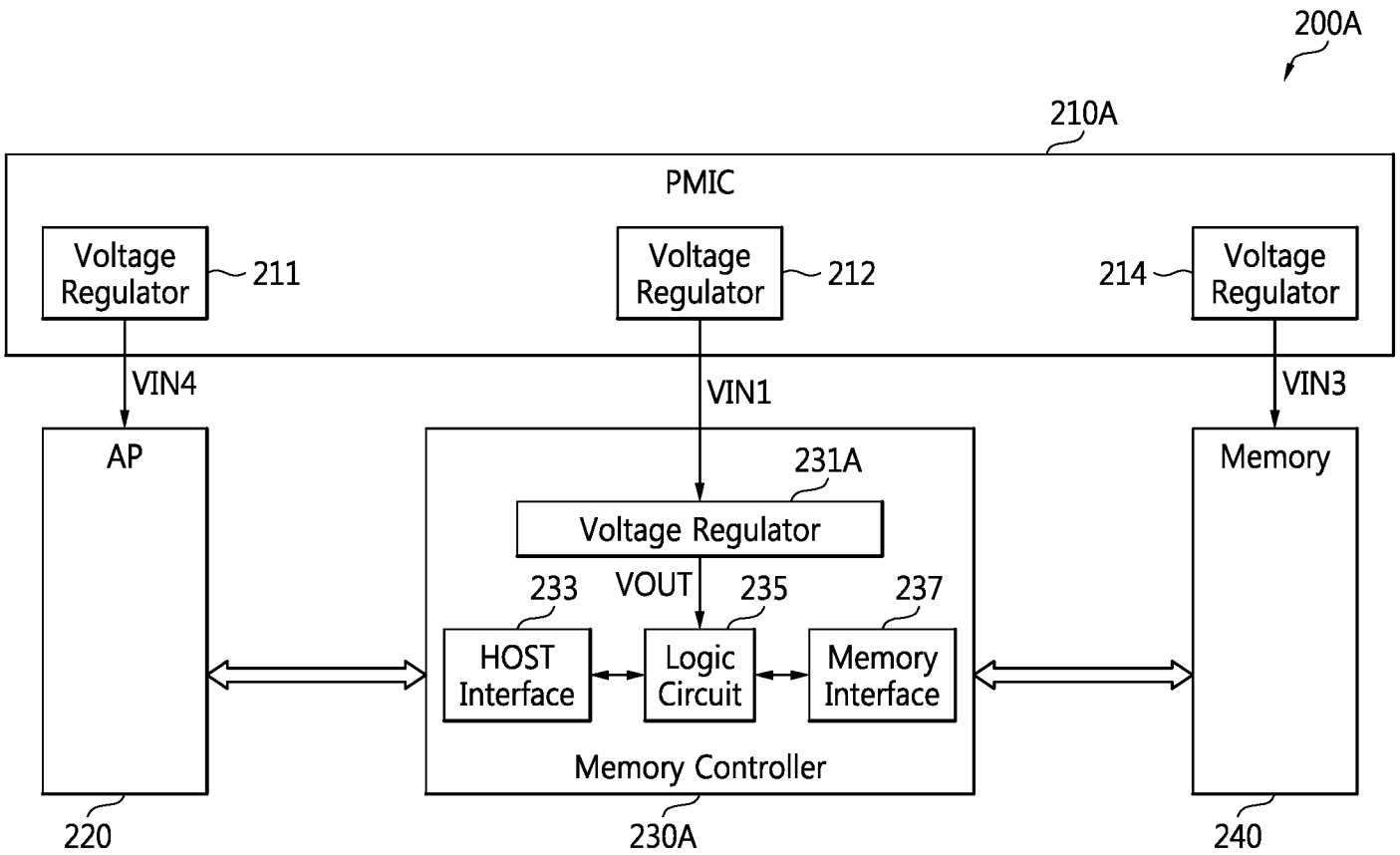
FIG. 11 is a block diagram of a mobile device including the voltage regulator illustrated in FIG. 1 or 2 according to some example embodiments of the inventive concepts.

FIG. 11 is a block diagram of a mobile device 200A including the voltage regulator 100A or 100B illustrated in FIG. 1 or 2 according to some example embodiments of the inventive concepts.

Referring to FIGS. 1 through 11, the mobile device 200A may include a power management IC (PMIC) 210A, an application processor (AP) 220, a memory controller 230A, and a memory 240.

The mobile device 200A may be implemented as a laptop computer, a cellular phone, a smart phone, a tablet personal computer (PC), a personal digital assistant (PDA), an enterprise digital assistant (EDA), a digital still camera, a digital video camera, a portable multimedia player (PMP), a personal navigation device or portable navigation device (PND), a handheld game console, a mobile internet device (MID), a wearable computer, an internet of things (IoT) device, an internet of everything (IoE) device, a drone, or an e-book.

The PMIC 210A may include voltage regulators 211, 212, and 214 which respectively generate voltages VIN4, VIN1, and VIN3. Each of the voltage regulators 211, 212, and 214 may be an LDO voltage regulator or a switching voltage regulator (e.g., a buck converter). Each of the voltage regulators 211, 212, and 214 may be one of the voltage regulators 100A through 100D described with reference to FIGS. 1 through 10C.

The first voltage regulator 211 may generate the fourth voltage VIN4 supplied to the AP 220. The second voltage regulator 212 may generate the first voltage VIN1 supplied to the memory controller 230A. The fourth voltage regulator 214 may generate the third voltage VIN3 supplied to the memory 240.

The memory controller 230A using the single power VIN1 may include a voltage regulator 231A, a host interface 233, a logic circuit 235, and a memory interface 237. The voltage regulator 231A may be one of the voltage regulators 100A and 100B described with reference to FIGS. 1 through 10C. The voltage regulator 231A may supply the output voltage VOUT to the logic circuit 235. The logic circuit 235 may be the loading block 140, but example embodiments of the inventive concepts are not restricted thereto. For example, although the output voltage VOUT is supplied to the logic circuit 235 in the embodiments illustrated in FIG. 11, the output voltage VOUT may be supplied to the host interface 233 and/or the memory interface 237 in other example embodiments.

The host interface 233 may interface signals between the AP 220 and the logic circuit 235. The memory interface 237 may interface signals between the logic circuit 235 and the memory 240. The memory interface 237 may be a memory controller interface.

The AP 220 using the fourth voltage VIN4 may control the operation of the memory controller 230A and may communicate signals with the memory controller 230A. The memory controller 230A may control the operations, e.g., the write and read operations, of the memory 240 according to the control of the AP 220 and may communicate data with the memory 240.

The memory 240 using the third voltage VIN3 may be formed of volatile or non-volatile memory. The volatile memory may be random access memory (RAM), dynamic RAM (DRAM), or static RAM (SRAM). The non-volatile memory may be electrically erasable programmable read-only memory (EEPROM), flash memory, magnetic RAM (MRAM), spin-transfer torque MRAM, ferroelectric RAM (FeRAM), phase-change RAM (PRAM), or resistive RAM (RRAM).

Figure 12:
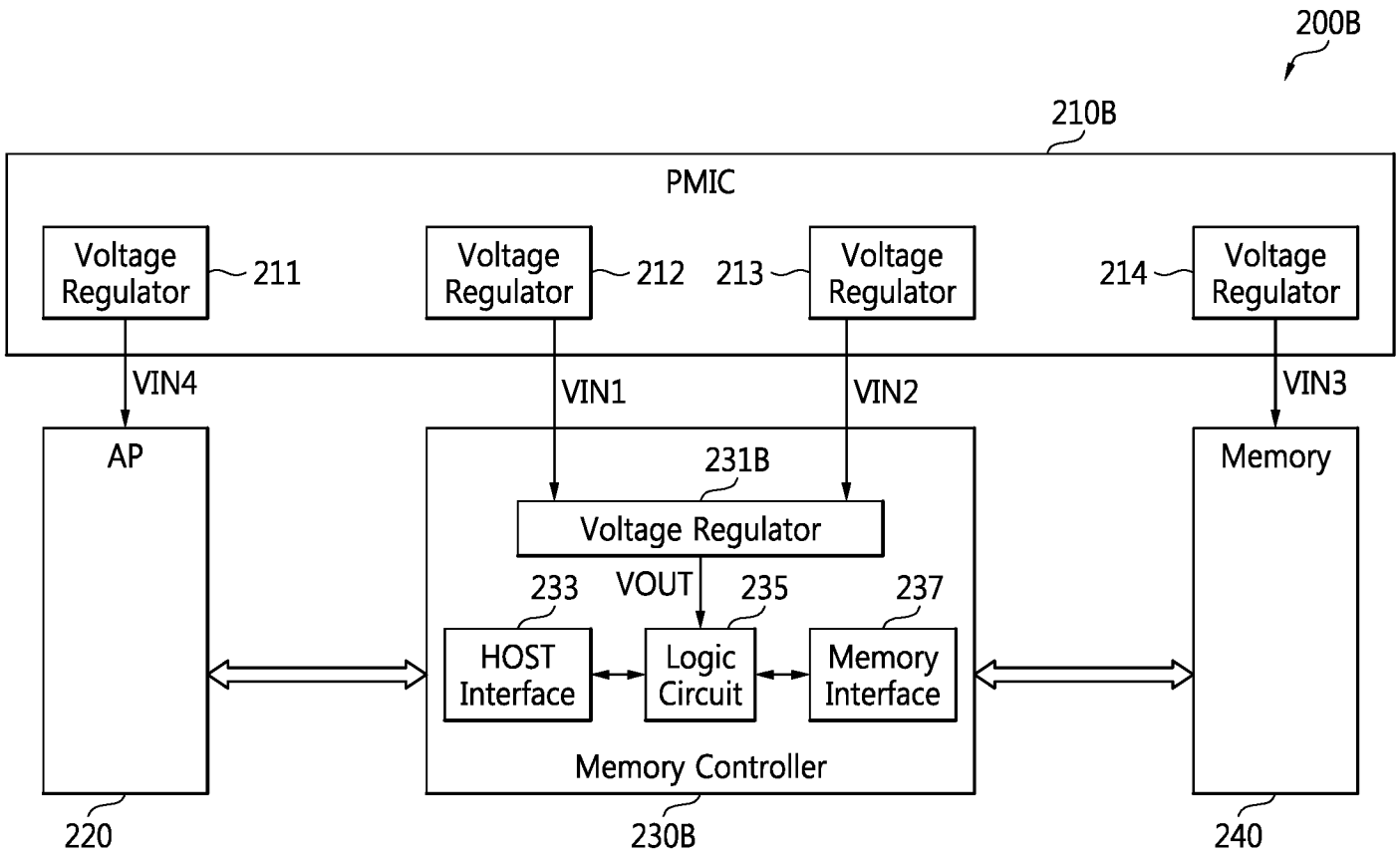
FIG. 12 is a block diagram of a mobile device including the voltage regulator illustrated in FIG. 3 or 4 according to some example embodiments of the inventive concepts.

FIG. 12 is a block diagram of a mobile device 200B including the voltage regulator 100C or 100D illustrated in FIG. 3 or 4 according to other example embodiments of the inventive concepts.

Referring to FIGS. 1 through 10C and FIG. 12, the mobile device 200B may include a PMIC 210B, the AP 220, a memory controller 230B, and the memory 240.

The mobile device 200B may be implemented as a laptop computer, a cellular phone, a smart phone, a tablet personal computer (PC), a personal digital assistant (PDA), an enterprise digital assistant (EDA), a digital still camera, a digital video camera, a portable multimedia player (PMP), a personal navigation device or portable navigation device (PND), a handheld game console, a mobile internet device (MID), a wearable computer, an internet of things (IoT) device, an internet of everything (IoE) device, a drone, or an e-book.

The PMIC 210B may include voltage regulators 211, 212, 213, and 214 which respectively generate voltages VIN4, VIN1, VIN2, and VIN3. Each of the voltage regulators 211, 212, 213, and 214 may be an LDO voltage regulator or a switching voltage regulator (e.g., a buck converter). Each of the voltage regulators 211, and 214 may be one of the voltage regulators 100A through 100D described with reference to FIGS. 1 through 10C. F The first voltage regulator 211 may generate the fourth voltage VIN4 supplied to the AP 220. The second voltage regulator 212 may generate the first voltage VIN1 supplied to the memory controller 230B. The third voltage regulator 213 may generate the second voltage VIN2 supplied to the memory controller 230B. The fourth voltage regulator 214 may generate the third voltage VIN3 supplied to the memory 240.

The memory controller 230B using the multi-power VIN1 and VIN2 may include a voltage regulator 231B, the host interface 233, the logic circuit 235, and the memory interface 237. The voltage regulator 231B may be one of the voltage regulators 100C and 100D described with reference to FIGS. 3 and 4. The voltage regulator 231B may supply the output voltage VOUT to the logic circuit 235. Although the output voltage VOUT is supplied to the logic circuit 235 in the embodiments illustrated in FIG. 12, the output voltage VOUT may be supplied to the host interface 233 and/or the memory interface 237 in other example embodiments.

Figure 13:
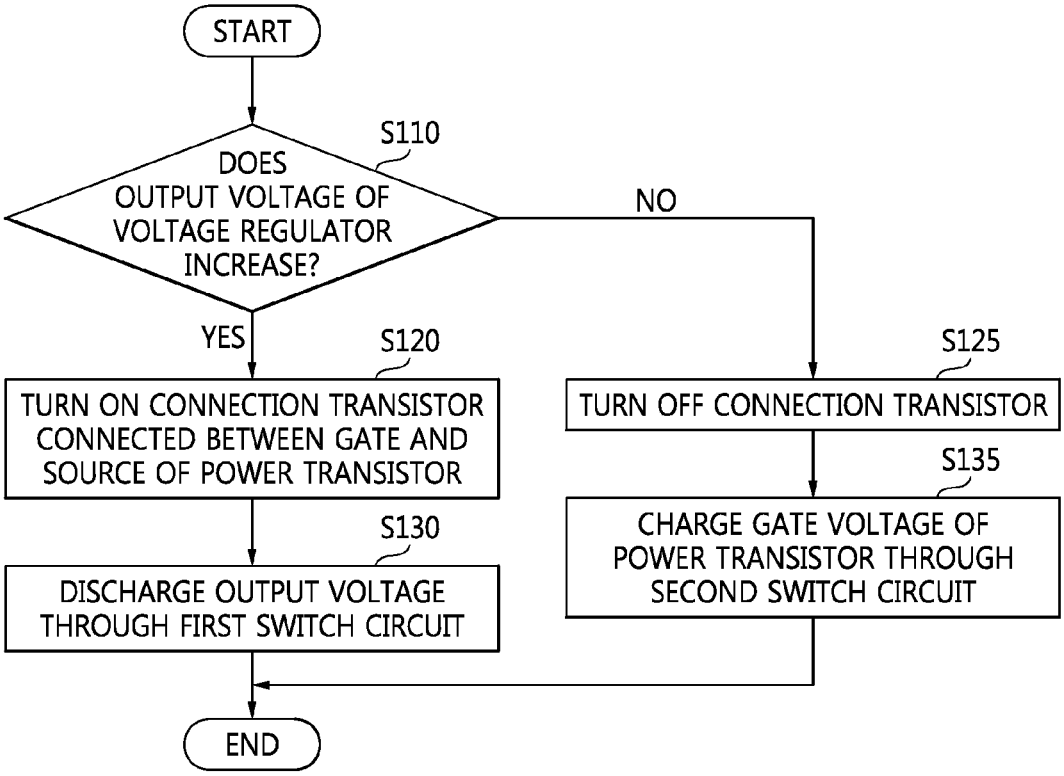
FIG. 13 is a flowchart of the operation of each of the voltage regulators illustrated in FIGS. 1 through 4.

FIG. 13 is a flowchart of the operation of each of the voltage regulators 100A through 100D illustrated in FIGS. 1 through 4.

Referring to FIGS. 1 through 13, in operation S110, the output voltage VOUT of the voltage regulator 100A, 100B, 100C, or 100D may increase (e.g., rapidly increase) due to overshoot, leakage current, and/or reverse current, thus causing a conduction connection of the connection transistor M1 connected between the gate 121 and source of the power transistor PTR. If the output voltage VOUT increases, the voltage regulator 100A-D may proceed to operation S120. Alternatively, the output voltage VOUT may decrease (e.g., rapidly decrease) due to undershoot. If the output voltage VOUT decreases, the voltage regulator 100A-D may proceed to operation S125.

In operation S120, when the conduction condition of the connection transistor M1 connected between the gate 121 and source of the power transistor PTR is satisfied due to the increase of the output voltage VOUT, the connection transistor M1 may turn on.

In operation S130, as the output voltage VOUT continues to increase, the first switch circuit 115-1 connects the gate 121 of the power transistor PTR to the ground GND. Accordingly, the output voltage VOUT and/or the current of the output node OND is discharged to the ground GND until the connection transistor M1 is turned off.

Alternatively, as discussed above, in operation 110, the output voltage VOUT of the voltage regulator 100C or 100D may decrease or rapidly decrease due to undershoot.

In operation S125, when the output voltage VOUT decreases, the connection transistor M1 is turned off.

In operation S135, as the output voltage VOUT continues to decrease, the first switch circuit 115-1 is turned off and the second switch circuit 115-2 is turned on. Accordingly, the second switch circuit 115-2 connects the first voltage supply node 101 with the gate 121 of the power transistor PTR. Since the first voltage VIN1 is supplied to the gate 121 of the power transistor PTR until the second switch circuit 115-2 is turned off, the voltage VGATE of the gate 121 is charged.

As described above, according to some example embodiments of the inventive concepts, a voltage regulator 100A-D provides a fast-transient response to the change in load current. The voltage regulator 100A-D discharges leakage current induced by a power transistor to a ground using an internal fast loop coupled to a connection transistor, so that the power transistor uses minimum quiescent current. As a result, the voltage regulator 100 A-D is highly efficient.

In addition, the voltage regulator 100A-D discharges reverse current, which flows from a load or a loading block toward an output node of the voltage regulator or the power transistor, to the ground using the internal fast loop coupled to the connection transistor, thereby preventing its output voltage from increasing. The voltage regulator 100A-D also provides a very compact design solution and high efficiency.

While example embodiments of the inventive concepts have been particularly shown and described with reference to some example embodiments thereof, it will be understood by those of ordinary skill in the art that various changes in forms and details may be made therein without departing from the spirit and scope of the example embodiments of the inventive concepts as defined by the following claims.

What is claimed is:

1. A voltage regulator configured to receive a first voltage at a first voltage supply node, and to supply an output voltage to an output node, the voltage regulator comprising:

an error amplifier configured to amplify a difference between a reference voltage and a feedback voltage and generate a first amplified voltage based thereon;

a power transistor between a second voltage supply node and the output node of the voltage regulator, the power transistor including a gate configured to receive a gate voltage;

a buffer between the first voltage supply node and a ground, the buffer configured to generate the gate voltage based on the first amplified voltage;

a voltage divider between the output node and the ground, the voltage divider configured to generate the feedback voltage based on the output voltage; and a control circuit configured to control connection between the output node and the gate of the power transistor based on the output voltage and the gate voltage such that the output node is electrically connected to the ground through the gate of the power transistor.

2. The voltage regulator of claim 1, wherein the first voltage supply node is electrically connected to the second voltage supply node such that the first voltage supply node and the second voltage supply node are both configured to receive the first voltage.

3. The voltage regulator of claim 1, wherein the second voltage supply node is configured to receive a second voltage different from the first voltage.

4. The voltage regulator of claim 1, wherein the control circuit comprises:

a diode between the output node and the gate of the power transistor; and a first switch circuit configured to selectively electrically connect the gate of the power transistor to the ground based on the first amplified voltage.

5. The voltage regulator of claim 4, wherein the control circuit further comprises:

a connection transistor including a drain, a source and a body, the drain configured to electrically connect to the gate of the power transistor, the source configured to electrically connect to the output node, and the body configured to electrically connect to the diode such that the diode is between the body and the drain of the connection transistor.

6. The voltage regulator of claim 4, wherein when the output voltage of the output node increases, the control circuit is configured to suppress the output voltage by discharging a current to the ground through the diode and the first switch circuit until the diode turns off.

7. The voltage regulator of claim 4, wherein the control circuit is configured to discharge current flowing from the output node into the gate of the power transistor through the diode by discharging the current to the ground through the buffer and the first switch circuit.

8. The voltage regulator of claim 4, wherein the control circuit further comprises:

a second switch circuit configured to selectively electrically connect the first voltage supply node and the gate of the power transistor based on the first amplified voltage.

9. The voltage regulator of claim 1, wherein the control circuit is configured to prevent the gate voltage from being discharged down to 0V.

10. The voltage regulator of claim 1, wherein the control circuit is configured to, electrically connect the output node to the ground through the gate of the power transistor to suppress an overshoot in the output voltage, and electrically connect the first voltage supply node to the gate of the power transistor to suppress an undershoot in the output voltage.

11. An integrated circuit comprising:

a load electrically connected to the output node; and the voltage regulator of claim 1, the voltage regulator configured to supply the output voltage to the output node.

12. A mobile device comprising:

a power management integrated circuit configured to generate an operating voltage; and a voltage regulator configured to receive the operating voltage and to supply an output voltage to an output node, the voltage regulator including, an error amplifier configured to amplify a difference between a reference voltage and a feedback voltage and generate a first amplified voltage based thereon, a power transistor between a voltage supply node and the output node, the voltage supply node configured to receive the operating voltage, the power transistor including a gate configured to receive a gate voltage, a buffer between the voltage supply node and a ground, the buffer configured to generate the gate voltage based on the first amplified voltage, a voltage divider between the output node and the ground, the voltage divider configured to generate the feedback voltage based on the output voltage, and a control circuit configured to control connection between the output node and the gate of the power transistor based on the output voltage and the gate voltage such that discharge current flows into the output node to the ground through the gate of the power transistor.

13. The mobile device of claim 12, wherein the control circuit is configured to, electrically connect the output node to the ground through the gate of the power transistor to suppress overshoot in the output voltage, and electrically connect the voltage supply node to the gate of the power transistor to suppress undershoot in the output voltage.

14. The mobile device of claim 12, wherein the control circuit comprises:

a connection circuit configured to electrically connect the output node with the gate of the power transistor based on the difference between the output voltage and the gate voltage; and a first switch circuit configured to selectively electrically connect the gate of the power transistor to the ground based on the first amplified voltage.

15. The mobile device of claim 14, wherein when the output voltage of the output node increases, the control circuit is configured to discharge an increment of the output voltage to the ground through the gate of the power transistor until the connection circuit turns off.

16. The mobile device of claim 14, wherein the control circuit further comprises:

a second switch circuit configured to selectively electrically connect the voltage supply node and the gate of the power transistor based on the first amplified voltage.

17. A voltage regulator configured to supply an output voltage to an output node, the voltage regulator comprising:

a power transistor between a voltage supply node and the output node, the voltage supply node configured to receive an operating voltage, the power transistor including a gate configured to receive a gate voltage; and a control circuit configured to, suppress overshoot in the output voltage by electrically connecting the output node with the gate of the power transistor and electrically connecting the gate of the power transistor with a ground based on the output voltage, the gate voltage and a first amplified voltage such that the output node is electrically connected to the ground through the gate of the power transistor to discharge current from the output node, and suppress undershoot in the output voltage by electrically connecting the gate of the power transistor to the voltage supply node to increase the gate voltage to the operating voltage.

18. The voltage regulator of claim 17, further comprising:

an error amplifier configured to amplify a difference between a reference voltage and a feedback voltage and generate the first amplified voltage based thereon;

a buffer between the voltage supply node and the ground, the buffer configured to generate the gate voltage based on the first amplified voltage;

a voltage divider between the output node and the ground, the voltage divider configured to generate the feedback voltage based on the output voltage.

19. The voltage regulator of claim 17, wherein the control circuit comprises:

a pull-down circuit configured to suppress the overshoot by electrically connecting the gate of the power transistor to the ground based on a feedback voltage and a reference voltage, the feedback voltage being based on the output voltage; and a connection circuit configured to, maintain the gate voltage above a threshold when suppressing the overshoot, and suppress the undershoot by electrically connecting the gate of the power transistor to the voltage supply node based on the gate voltage and the operating voltage.

20. The voltage regulator of claim 19, wherein the connection circuit includes a connection transistor including a drain, a source and a body, the drain configured to electrically connect to the gate of the power transistor, the source configured to electrically connect to the output node, and the body configured to electrically connect to the source to form an intrinsic body-to-drain diode, and the control circuit is configured to suppress the output voltage by discharging a current to the ground through the intrinsic body-to-drain diode and the pull-down circuit until the intrinsic body-to-drain diode turns off, if the output voltage increases.

* * * * *